US007735607B2

(12) United States Patent
Kumar

(10) Patent No.: US 7,735,607 B2
(45) Date of Patent: Jun. 15, 2010

(54) GAGE SIDE OR FIELD SIDE TOP-OF-RAIL PLUS GAGE CORNER LUBRICATION SYSTEM

(75) Inventor: Sudhir Kumar, Darien, IL (US)

(73) Assignee: Tranergy Corporation, Bensenville, IL (US)

( * ) Notice: Subject to any disclaimer, the term of this patent is extended or adjusted under 35 U.S.C. 154(b) by 1045 days.

(21) Appl. No.: 11/042,302

(22) Filed: Jan. 24, 2005

(65) Prior Publication Data

US 2006/0163004 A1 Jul. 27, 2006

(51) Int. Cl.
*B61K 3/001* (2006.01)

(52) U.S. Cl. ..... 184/3.1; 184/15.3; 184/26; 291/1; 291/2; 291/3

(58) Field of Classification Search ..... 184/26, 184/15.3, 3.1; 291/1, 2, 3, 22
See application file for complete search history.

(56) References Cited

U.S. PATENT DOCUMENTS 2,518,786 A * 8/1950 Huck ..... 184/3.1
3,059,724 A * 10/1962 Soule, Jr. ..... 184/3.1
4,520,901 A * 6/1985 Borup et al. ..... 184/3.1
6,199,661 B1 * 3/2001 Kumar ..... 184/3.2
7,121,383 B2 * 10/2006 Kumar et al. ..... 184/3.1
7,273,131 B2 * 9/2007 Urmson et al. ..... 184/3.1
2003/0111295 A1 * 6/2003 Kumar et al. ..... 184/3.1

OTHER PUBLICATIONS

EPO Search Report Communication dated Oct. 29, 2007 for EPO Patent Application No. 06250379.2.

* cited by examiner

*Primary Examiner*—Bradley T King
*Assistant Examiner*—James K Hsiao
(74) *Attorney, Agent, or Firm*—Cook Alex Ltd.

(57) ABSTRACT

A rail lubricator for a railroad rail has a nozzle adjacent to the rail and attached thereto. The nozzle has a discharge orifice disposed beneath the top surface of the rail. The orifice is aimed generally longitudinally of the rail with the aiming including an upward component and a lateral component toward the centerline of the rail. Jets of lubricant project upwardly from the nozzle, arch above the top surface of the rail, and then fall onto the top surface and gage corner of the rail. This lubricates the top of a rail using an optimum amount of lubricant on the optimum area of the railhead. The lubricant is applied when the nozzles are spanned by a car.

26 Claims, 9 Drawing Sheets

GAGE SIDE OR FIELD SIDE TOP-OF-RAIL PLUS GAGE CORNER LUBRICATION SYSTEM

BACKGROUND OF THE INVENTION

This invention concerns a method and apparatus for applying lubricant to railroad rails. Rail lubrication on curves has been considered important for a long time, primarily for the purpose of reducing wear on wheels and rails. Traditionally, lubricating devices in railroad yards used long bars mounted on the gage side of the rail. Grease oozes out of small holes in the bar in response to the pressure of a passing train, and is picked up by the flanges of wheels and spread over the rail gage corner. These grease lubricators are difficult to control, leading to excessive grease being applied and accumulated near the applicator. It is messy, manpower intensive, hazardous to track crews, and expensive to maintain. In spite of such lubrication, high lateral forces continue to develop on the rail. This produces significant damage to track components such as spikes, ties, tie plates, ballast and the overall structure of the track.

A new approach called top-of-rail lubrication was introduced by Kumar in the early 1990s. See U.S. Pat. Nos. 5,477,941 and 5,896,947. In this approach, a lubrication system mounted on the last locomotive consistently applied lubricant or friction modifier on top of the rail as the train moved forward. This approach has been very beneficial, and today the railroad industry generally utilizes the top-of-rail method of lubrication. Since this system is installed on board a locomotive, it falls under the authority of the mechanical department in a railroad.

The engineering department of a railroad also needs a system for top-of-rail lubrication on curves. Recently, two different systems have been developed for achieving this. One system follows the approach similar to gage side grease lubricators. In this approach a long bar is installed on the field side and top of the rail. When wheels pass by, the pressure causes the lubricant to ooze out of the strip to be spread on the rail. This is not effective because it does not provide lubrication where it is needed most, particularly on the low rail in a curve. Also, the lubricant is not carried along the track for a sufficient distance.

There is a second approach called the wayside wheel lubricator which is currently at work in many railroad yards. This is shown in Kumar, U.S. Pat. No. 6,585,085, assigned to Tranergy Corporation. In this method, lubricant is applied through a nozzle to the wheels of approaching cars in a yard which move at relatively slow speeds (10 miles per hour or less). While this method is effective in railroad yards, for cars traveling at higher speeds (40 to 70 miles per hour) the lubricant application jet will have difficulty accurately hitting fast approaching wheels. There is therefore a great need for a ground-based, top-of-rail lubrication system which lubricates the contact area of the rail using an optimum amount of lubricant on the optimum area of the railhead.

SUMMARY OF THE INVENTION

To solve the above problems, this invention is directed to a method and apparatus for dispensing lubricant on at least one railroad rail. This invention offers a way to lubricate the contact area of the rail with proper and accurately controlled lubrication on the optimum area of the railhead. One or more nozzles are mounted in a block or strip, which is mounted on the rail gage side. The nozzles are preferably located below the railhead in order to stay clear of passing wheel flanges.

The jets of lubricant fluid from the nozzles are aimed in such a way that the fluid exits the nozzle upwards and towards the rail and then falls on the rail. This requires the jet to be quite close to the railhead and aimed at an angle up and into the rail. As the jet exits the nozzle orifice, it grazes the edge of the rail which disperses the jet and creates a generally vertical curtain or sheet of lubricant. The curtain then falls onto a significant length of the rail. One or more such jets are fired by the nozzle holder simultaneously on the contact area of the rail in different directions from the applicator such that they fall on the railhead and gage corner. A correct distribution of fluid is thus applied to the contact area of the rail on different parts of the railhead, including the gage corner of the rail. As the wheels roll on this lubricated railhead, the fluid is picked up by the wheels and spread on the wheel tread and flange, as well as on the rail. The shots of fluid are fired on the rail when the wheel is at a reasonable distance (2 to 20 feet, or more) from the nozzle. Two sensors, one on each side of the nozzle holder, detect the presence of approaching wheels from either direction and cause the jet to be ejected when the wheels are absent from the target zone to be wetted with lubricant. The wheel detecting sensors are also preferably mounted on the gage side of the rail.

This method and apparatus for lubricating the contact area of the rail can be distinguished from the above-mentioned wayside lubricator of Kumar U.S. Pat. No. 6,585,085. The wayside lubricator aims a jet of lubricant directly at the wheels. With this aiming even if the timing were altered to avoid hitting a wheel, the wayside lubricator would still not lubricate the rail in the manner of the present invention. In fact, if a jet in the wayside lubricator were fired between passing wheels, the jet would shoot directly over the rail and land in between the rails or on the field side of the opposite rail, or the jet would hit the undercarriage of a passing car.

An alternate method of placing the nozzle blocks or strip on the field side is also discussed. The fluid jets rise up and towards the rail and then fall on the contact area. Top-of-rail lubrication can be done by this method when it is not possible to mount the blocks on the gage side for some reason.

In yet another alternate embodiment, the nozzles are located above the railhead on the field side, but at a lateral position that allows the nozzles to stay clear of passing wheel flanges. The jets of lubricant fluid from the nozzles are aimed such that the lubricant projects downwardly and laterally towards the rail, where it is deposited on the rail.

Each nozzle holder block houses the nozzles and check valves for the different jets. Each nozzle directs the fluid jet in different directions on each rail in this way. The drawings show only two jets, one in the forward direction towards the approaching train and the other in the backward direction in which the train is moving. However, there can be many more jets if desired. The shot duration is determined by the amount of fluid to be applied to the rail. If the train is approaching at a very fast speed, the wheels may sometime intercept the jets fired towards it. However, the jets fired in the opposite direction (direction of train) will still fall on the rail. A computer controls the frequency and duration of each shot. The software is based on timing the approaching wheels such that at the instant the shot is fired, the nozzle holders are located intermediate the trucks of the car. However, this does not have to be so. A certain minimum number of shots (several) may need to be fired based on experience with the degree of lubrication needed. The logic for timing the shots is such that lubricant shots are not fired on the rail before passage of locomotive wheels. When three axles pass over the sensor, equal time apart or when time duration is longer between axles than those of cars, it is identified as a locomotive wheel and the lube shot on the rail is not fired. By this approach the locomotives and possibly the first car will pass before the system starts lubricating the rail. An environmentally clean top-of-rail curve lubricant, which flows smoothly under different temperature conditions, is used for this purpose. An enclosure or box located on the track wayside contains the computer, fluid and hydraulic and electrical control systems. Hoses from the box transmit fluid to each of the nozzle holders. The fluid is pressurized by a finite displacement pump or another system which can deliver controlled quantities of the fluid shot. Electrical connections are provided from the box to the two sensors mounted on the rail on either side of the nozzle holder block. AC power can be used for the box where available. If not, DC power from a battery, which is charged by solar cells, is used.

DETAILED DESCRIPTION OF THE INVENTION

Figure 1:
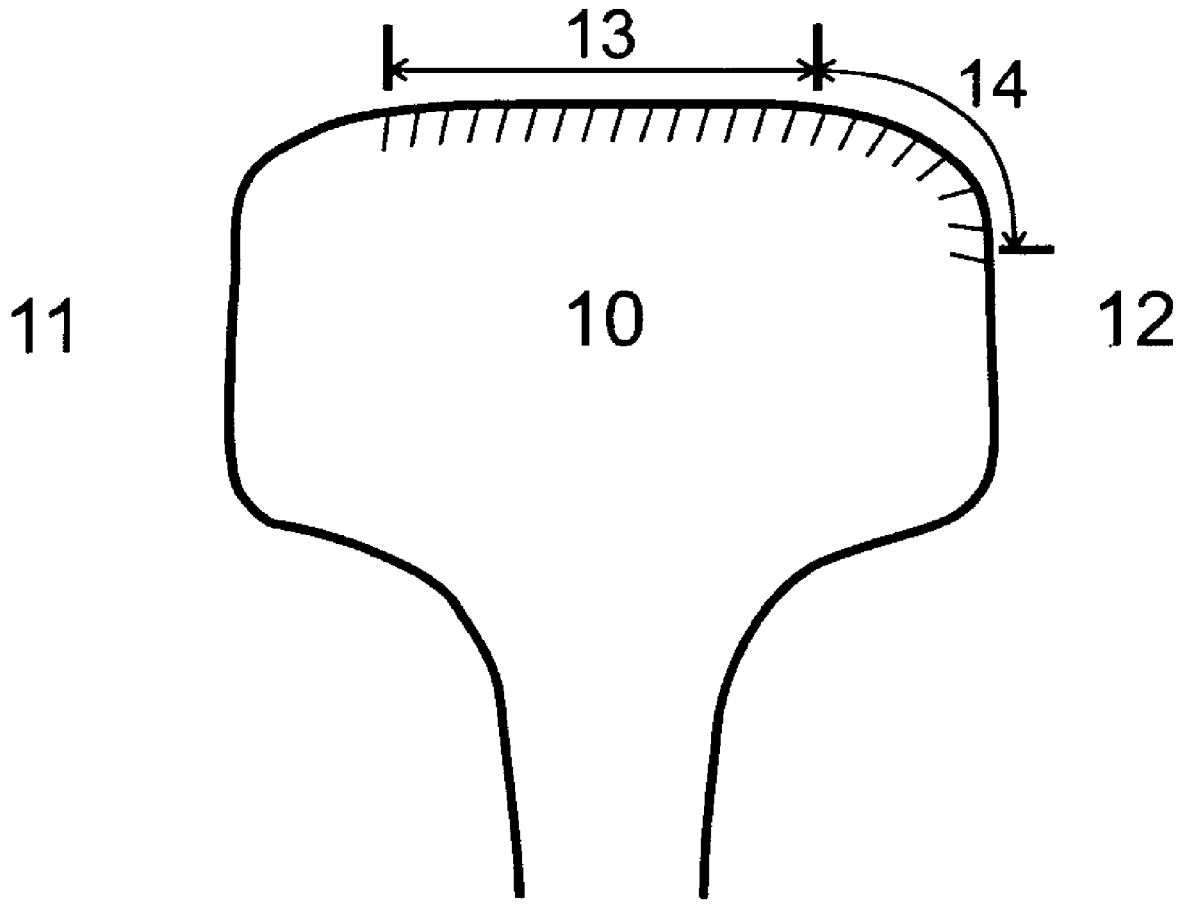
FIG. 1 is a cross-section of a railhead illustrating two regions where wheels contact the rail.

FIG. 1 illustrates the zone of wheel-rail contact on a railhead that defines the regions of the rail requiring lubrication on a curve. The railhead 10 can be either the high rail or the low rail. The field side of the rail is at 11 and the gage side is indicated at 12. The contact area of the wheel on the high rail (for most train operating conditions) is marked with hashed lines. This area can be broken into two regions 13 and 14. Region 13 is essentially the top of the rail and region 14 is the gage corner. The two regions collectively will be referred to herein as the contact area. The wheel tread contacts the rail in different parts of region 13 and the wheel flange contacts the rail in parts or all of region 14. Friction work on the high rail is done by the wheel in both regions 13 and 14. For the low rail a mirror reflection on the right can be considered. However, the contact of wheel and low rail generally lies only in region 13. Only for very low train speeds (below equilibrium speed) contact can develop in region 14 of the low rail.

For optimum reduction of lateral forces, wear of wheel and rail, and damage to the track structure, it is essential to lubricate both regions 13 and 14 for both high and low rail for cars on a curve. It is best to lubricate accurately in controlled small quantities and skip the lubrication of the rail before passage of locomotive wheels altogether to avoid any wheel slip or loss of adhesion. This has not been possible to date other than by the wayside wheel lubricator system of Kumar, U.S. Pat. No. 6,585,085 which lubricates the treads and flanges of passing wheels. It works well in railroad yards at low car speeds. The present invention offers a method of lubricating both regions 13 and 14 of rails on curves for revenue service train cars for the benefit of a railroad's engineering department, which has the responsibility to protect the track on curves.

Figure 2:
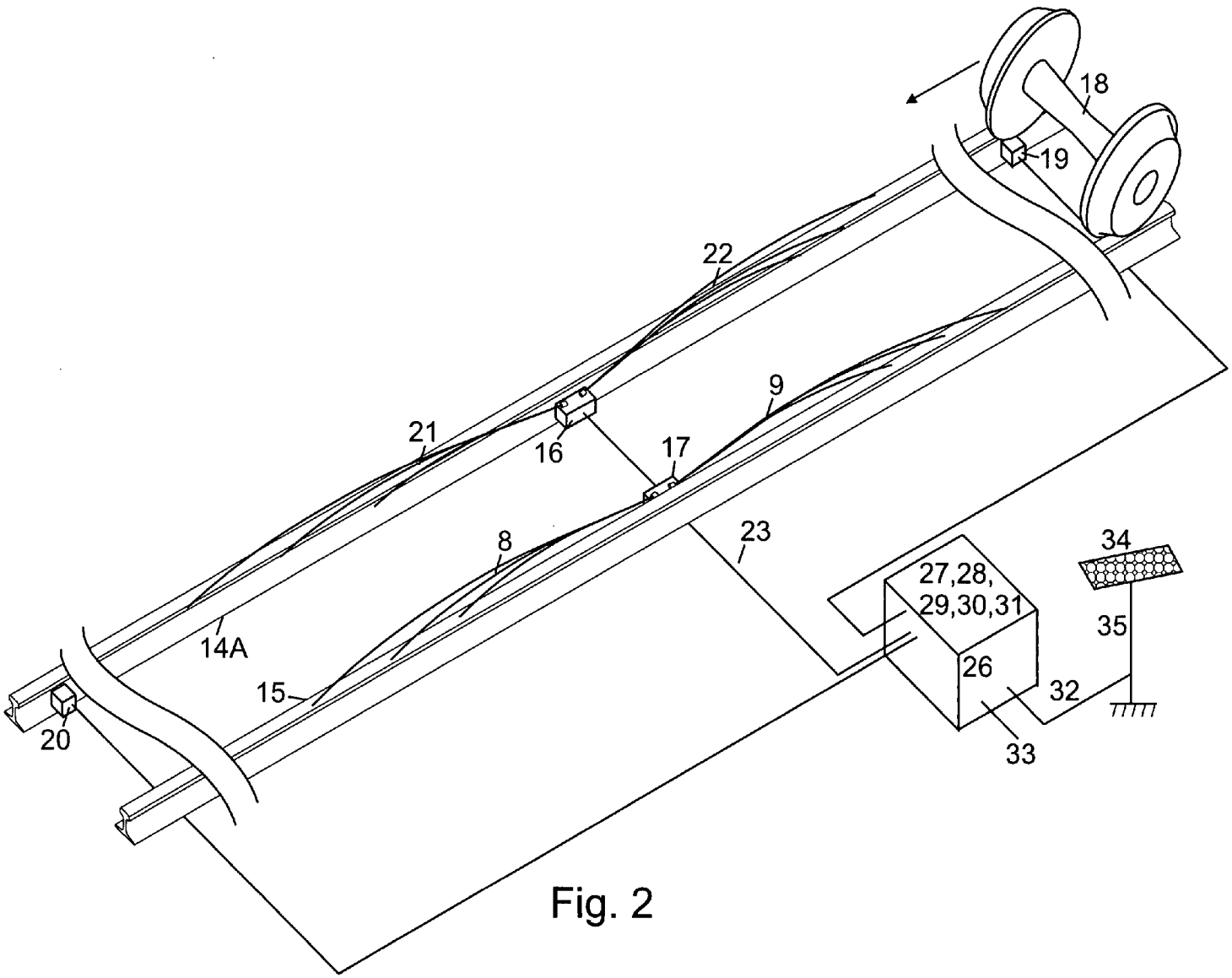
FIG. 2 is a schematic perspective view of the gage side top-of-rail lubricator according to the present invention, with a wheel set and axle of a car approaching a sensor and triggering four shots of top-of-rail lubricant.

FIG. 2 shows a general schematic arrangement of the gage side top-of-rail lubrication system of the present invention using two fluid jets on each rail. Alternately, one jet may be used or more than two jets may be used. Two rails 14A and 15 are shown with two nozzles 16 and 17, mounted on the gage side of each rail. An approaching wheel set at 18 is sensed by a sensor 19. When the software selects this particular wheel set to trigger a shot of lubricant on the rail, the two nozzles 16 and 17 fire two shots each 21, 22 and 8, 9. These shots will coat the rail top surface and the gage corner of the two rails so that the wheel set 18 will experience a coated rail both on the tread and the flange contacts with the rail. During this process the surfaces of the tread and the flange of the wheel set 18 will develop a film of the lubricant. If the train is approaching from the right, sensor 19 will trigger the firing of the jets. Any pulse recorded from sensor 20 would in this instance be ignored. If the train were coming from the left, sensor 20 would trigger the system while the pulse from sensor 19 would be ignored. The nozzles 16 and 17 each include a nozzle body which contains the nozzle passages, discharge orifices and check valves. The two bodies are supplied the lubricant through supply lines 23 which may be suitable hoses or pipes.

The distance from the nozzles 16, 17 to the sensors 19 and 20 should be selected based on the average speed of trains at the lubricator's location. By way of example and not by limitation, the sensors can be located seven or eight feet from the nozzles when the average train speed is 10 miles per hour. If the average train speed is 30 to 40 miles per hour, the sensors should be spaced about fifteen feet from the nozzles. High speed traffic of 60 to 70 miles per hour would best be handled by a sensor-to-nozzle distance of about twenty feet. While these precise figures could vary somewhat, the basic idea is to increase the distance as speed increases to allow sufficient time for the software to react to the sensors, fire a lubricant shot and have the shot land on the rail without interruption by a passing truck.

The supply lines are connected to a wayside box or housing 26. The housing 26 contains a finite displacement pump with motor 28, a lubrication tank 29 and a controller 27. The controller determines the quantity of lubricant to be fired in each shot with its control of the finite displacement pump. Other methods of control are possible. The pump and controller may be powered by AC current 33 or DC current 32. For DC current the power may be provided by a solar panel 34 mounted on the pole 35 and the power is processed by a power pack 31 to charge a battery 30. The battery 30 provides the electrical current and voltage to the motors connected to the pump motor 28. The frequency of firing the jet shots 21, 22 and 8, 9 is controlled by software in the controller. Thus, the amount of fluid applied to the top of the rail and gage side is fully controlled in order to reduce the friction between wheels of cars and rails in an accurate and controllable way.

Figure 3:
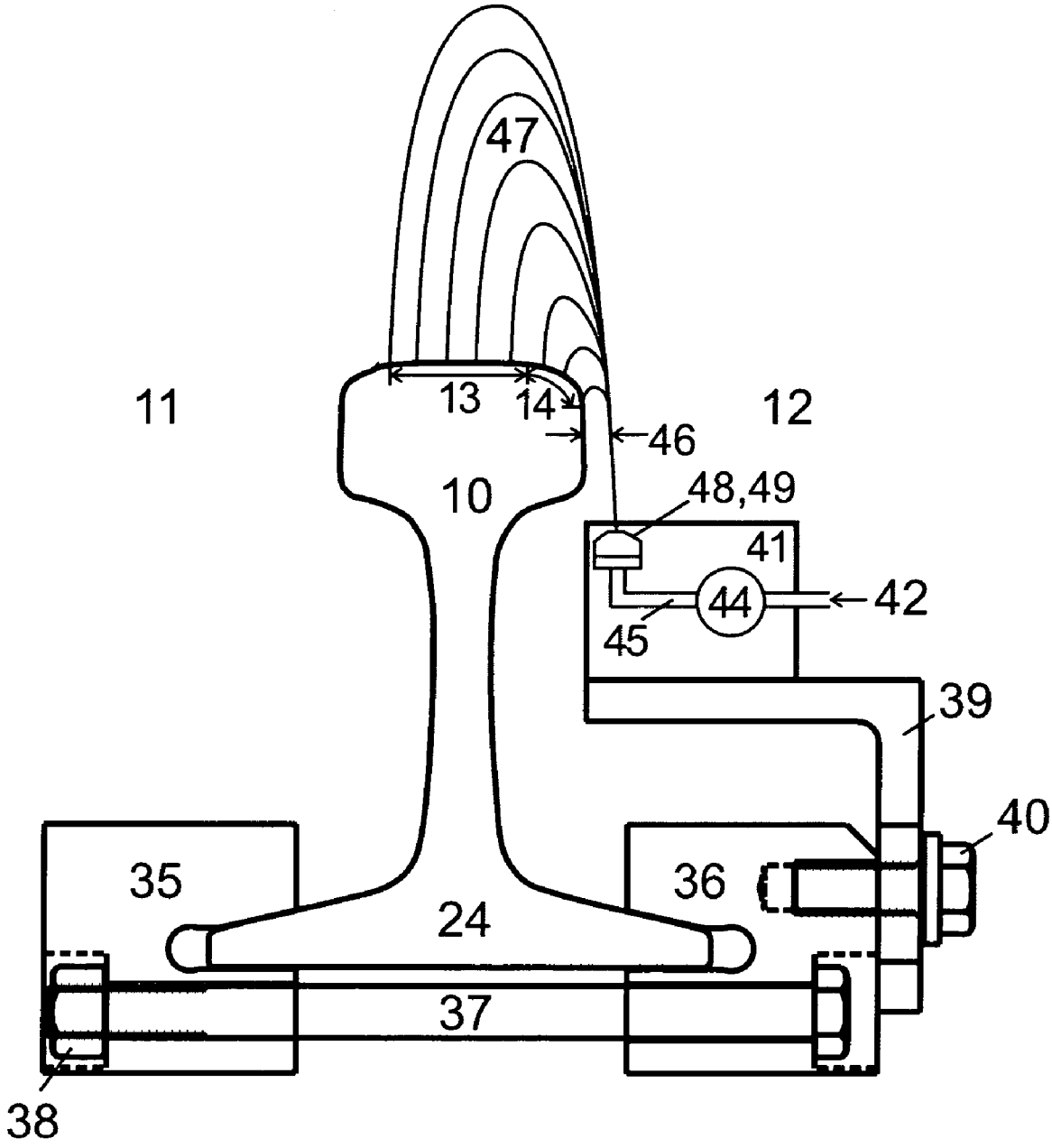
FIG. 3 is a cross-section of a rail with an installed block containing a nozzle and check valve installed on the gage side of the rail and firing a top-of-rail lubricant jet on the rail head and gage corner.

FIG. 3 shows a cross sectional view of a railhead 10 with the gage side 12 and field side 11 marked on the sides. On the base 24 of the rail two brackets 35 and 36 are installed with bolt 37 and nut 38. On the gage side bracket 36 there is another angle-shaped L section 39. It is mounted on bracket 36 by bolts 40. Slots in the L section 39 permit vertical adjustment of the L section. The L section supports a nozzle body 41 in which the nozzle passages 45 and discharge orifices 48, 49 are defined. A check valve 44 is disposed in passage. The check valve provides both directional control and pressure regulating functions. That is, the check valve prevents flow from the orifice into the supply lines. And the check valve will not open unless the line pressure achieves a prescribed minimum. The lubricant fluid enters the passage 45 from supply line 23 through a hose connector 42. The check valve 44 checks the flow for both nozzles 48, 49. The lubricant flow is controlled by the finite displacement pump in the housing.

The fluid jets 46 coming out of the nozzle discharge orifices 48, 49 are aimed at a small angle up and into the rail. The number of jets and the angle with the horizontal direction of the rail can be varied for different applications. A small angle with a vertical plane through the axis of the rail, towards the centerline of the rail, is essential in order to insure that the fluid rises in a nearly vertical plane above the railhead and then falls on to it. The angle of the jet can be between 1° and 90° above the horizontal with 5° being a preferred angle. The angle of the jet compared to the longitudinal axis of the rail can be 0.1° to 80° with 2° being preferred. The horizontal distance of the nozzle discharge orifice from the railhead can be between 1/16" to 2". Also, in order to be below the height of the wheel flanges rolling on the rail, gage side nozzle bodies must be between ¾ to 3 inches below the top of the rail, depending on the size of the wheel flanges and the railhead height. 2¼ inches below the top of the rail is preferred. Field side nozzle bodies can be closer to the top of the rail head, somewhere between ⅛ to 2 inches being suitable.

The nozzles are also aimed such that the jet slightly grazes a corner of the railhead. This causes the jet to disperse into a generally vertical sheet or curtain of fluid. Creating a curtain of fluid increases the length of the wetted area of the rail. That is, grazing the rail breaks up the jet into a curtain so that portions of it fall closer to the nozzle than would otherwise be the case. With the curtain some portions of the fluid jet will land at relatively close distance from the nozzle, other portions will land at intermediate distances from the nozzle, and still other portions will land at maximum distances from the nozzle. The curtain creates a continuously wetted area along the rail. In a typical installation the rail is wetted from about 3 feet to about 15 feet from the nozzle. If the jet were not dispersed in this manner it would still disperse naturally but in a smaller area and toward the far end of the jet's reach, somewhere in the vicinity of 10 feet from the nozzle. There are alternative ways to create the curtain, other than by aiming the jets to graze the rail. The nozzle discharge orifice could have a needle or the like that pricks the outgoing jet, causing it to disperse into a curtain of fluid.

Figure 4:
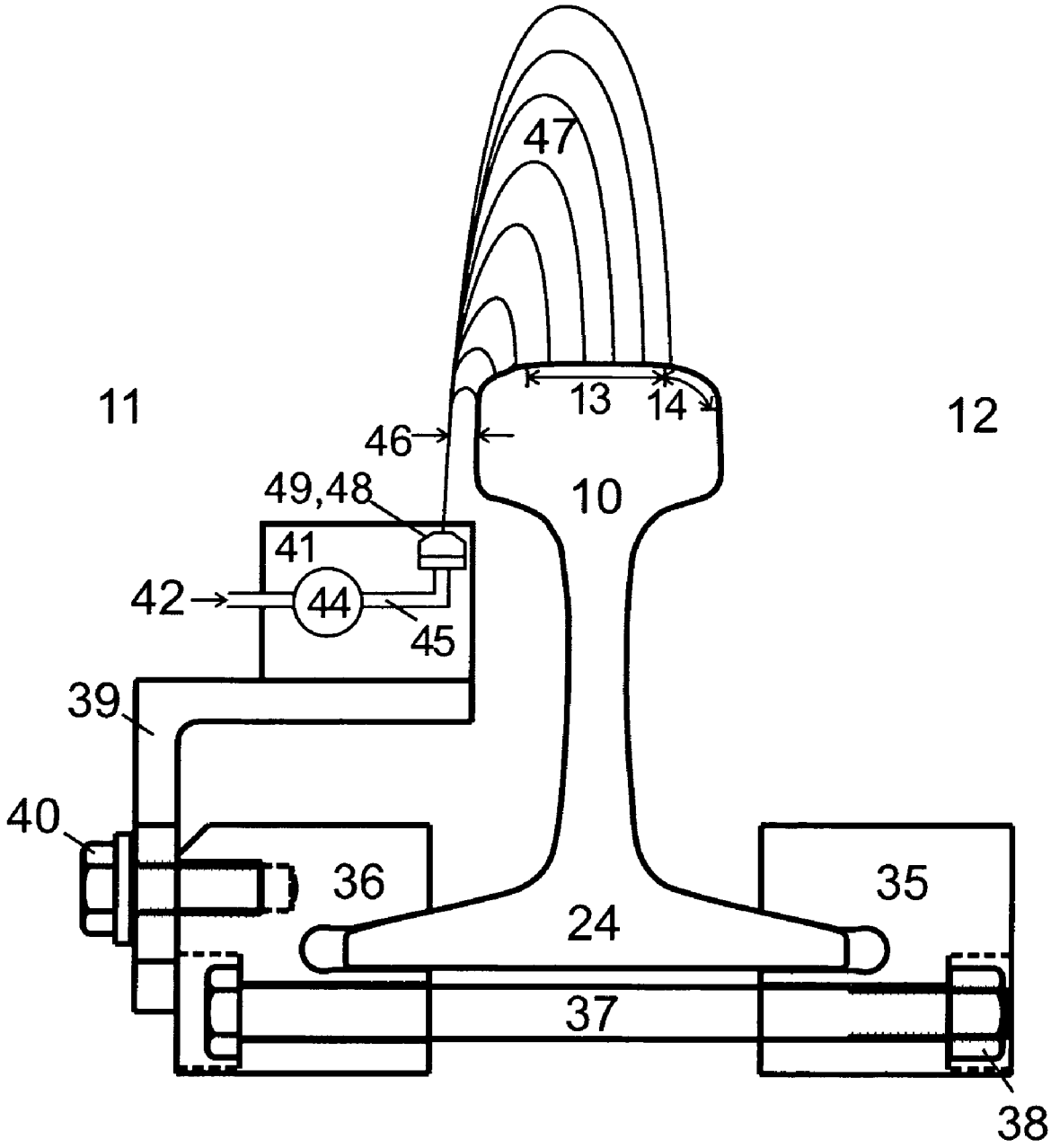
FIG. 4 is a cross-section of a rail showing an alternate embodiment wherein the nozzle block is placed on the field side of the rail.

Placement of the nozzle body 41 on the gage side 12 is the preferred mode because it enables lubrication both on top of the rail 13 and on the gage corner 14. In this arrangement, on a curve the lateral creep of the wheel helps to move the lubricant layer on the rail surface to get more into the wheel-rail contact area (FIG. 3). However, the nozzle body 41 could alternately be located on the field side 11. As shown in FIG. 4 a field side arrangement of the nozzle body is a direct reflection of the gage side arrangement. However, lubrication of the gage corner 14 is easier to achieve with the gage side mounting of the blocks 41 and thus it is the preferred arrangement. In either case, the fluid jet must rise up above the railhead and then fall onto the railhead to lubricate it. Unless otherwise noted, the remaining descriptions will refer to gage side placement of the nozzles (FIG. 3). The jet of lubrication travels above and along the rail and ultimately lands on the top of the rail 13 and on the gage corner 14 through differently oriented nozzle orifices ejecting the spray 47. In this way, the nozzle orifices and the nozzle body remain completely below the level of the wheel flanges running by the rail gage corner on the gage side 12. The fluid jet is ejected from the nozzle orifice in an upward projection and lands on top of the rail and the gage corner 14 along the rail as shown earlier in FIG. 2. The jet disperses into a curtain 47 as it goes farther from the nozzle orifice 48, 49. A greater amount of fluid per square inch falls on the gage corner 14 as compared to the top 13. This is desirable because more friction work is done on the gage corner 14.

Figure 5:
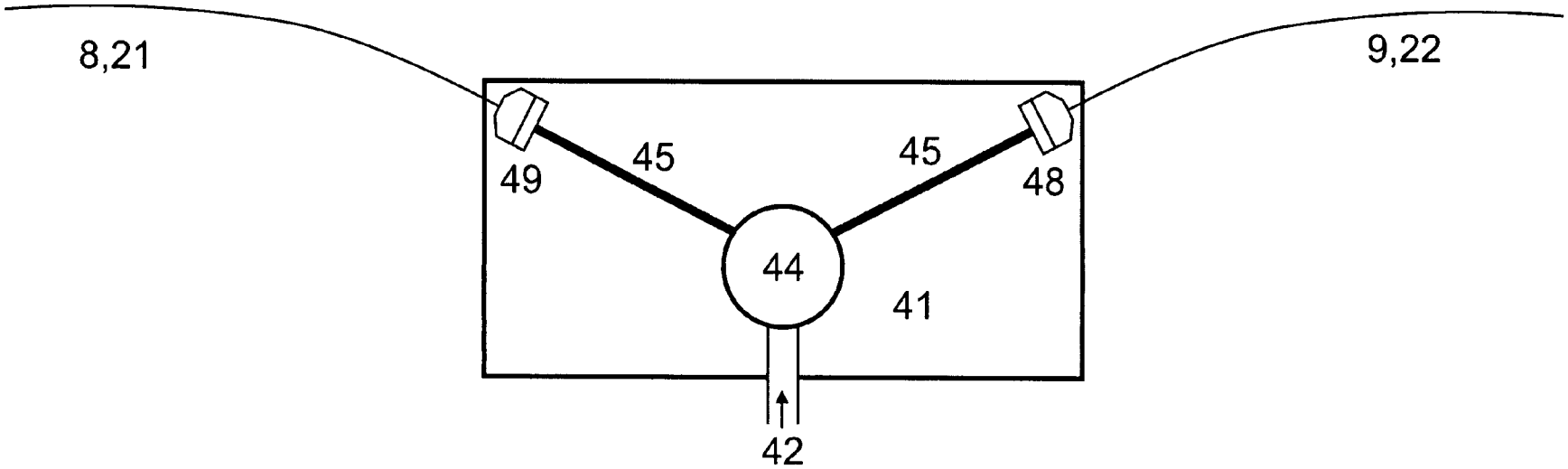
FIG. 5 is a side elevation view of a nozzle block with two top-of-rail lubricant jets being fired.

FIG. 5 shows a schematic arrangement of the nozzle body 41. The lubricant enters the nozzle body under pressure and goes through the connector 42, the check valve 44 and passages 45 to the nozzle orifices 48, 49 to come out as jets 8, 21 and 9, 22. The amount of fluid delivered in one shot is controlled by the finite displacement pump and the controller 27 in the housing 26. Thus, the controlled volume fluid jet 8 comes out of nozzle orifice 49 and jet 9 comes out of nozzle orifice 48.

Figure 6:
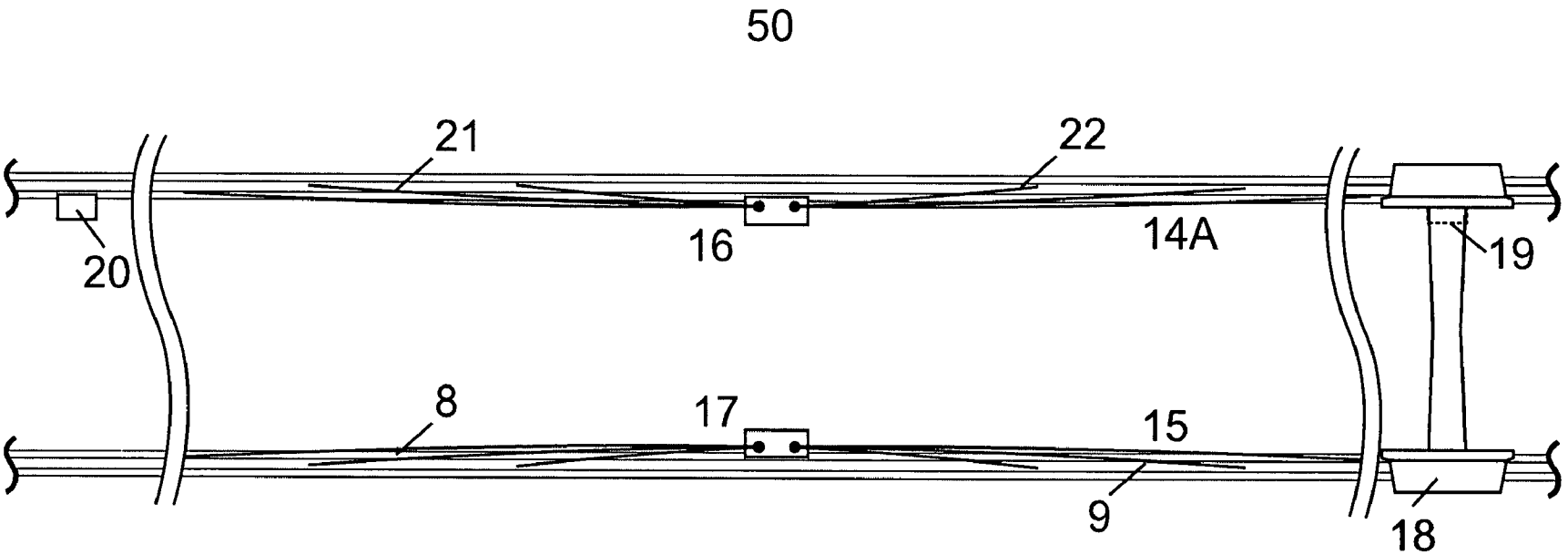
FIG. 6 is a top plan view of the top-of-rail lubricator firing two fluid jets on both rails when an approaching wheel triggers the sensor and the system.
Figure 7:
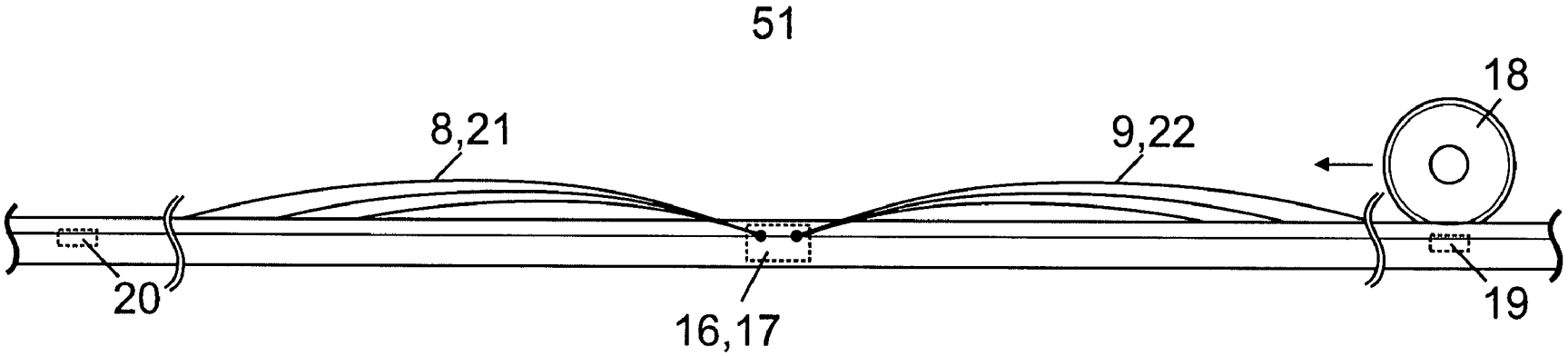
FIG. 7 is a side elevation view of the top-of-rail lubricator firing two fluid jets on both rails when an approaching wheel triggers the sensor and the system.

FIGS. 6 and 7 show a plan view 50 and a side view 51, respectively of the invention mounted on the rail, with the wheel 18 approaching the sensor 19 to trigger the fluid jets 8, 9 and 21, 22. The fluid jets 21, 22 and 8, 9 are fired from the nozzle bodies 16 and 17 on the rails 14A and 15 when the correct wheel 18 is sensed by the sensor 19. The fluid is ejected onto the rail from a level lower than the railhead to land on the gage corner and the top of the two rails 14A and 15.

Figure 8:
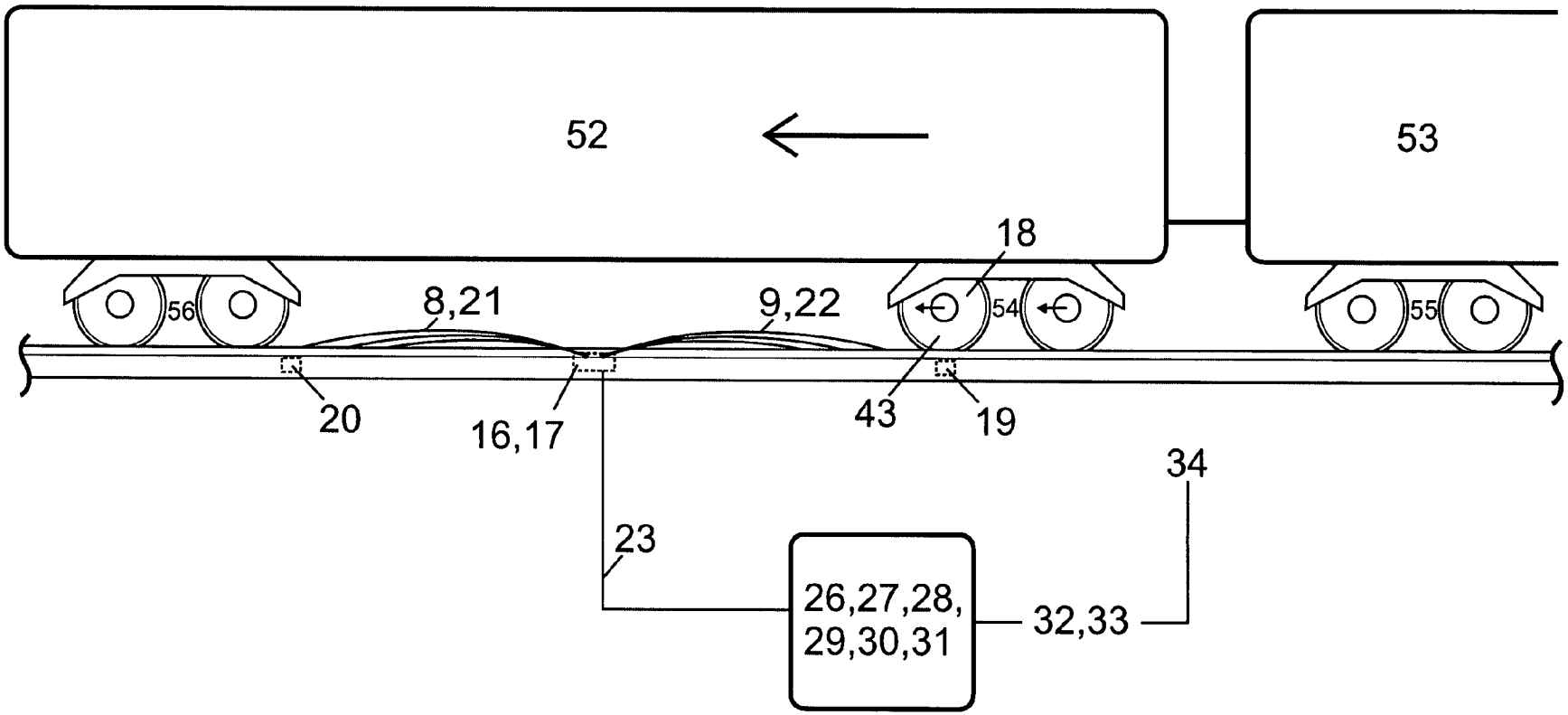
FIG. 8 is a side elevation view of cars on track illustrating the preferred moment of fluid jets firing on the rail relative to the car of a train that is directly above the nozzle block.

FIG. 8 shows the method of determining the timing of firing the lubricant shots on the rail. If the train is approaching from the right and cars 52 and 53 are near the nozzle body, sensor 19 will keep track of the axles passing by and trigger a shot when the lead axle of the truck 54 is on top of sensor 19. Trucks 54 and 55 are treated as a group of four axles. The identification is based on the time interval between sensing of the different wheels. The longer time interval indicates the long space of approximately 30 feet between the trucks of a single car. It is in that space that the fluid shots are fired.

When the train approaches one of the sensors, the sensor detects passage of a wheel and turns the pumping system on. The sensor identifies passage of a locomotive truck by several methods. If there are three wheels spaced by equal time intervals, it is a locomotive truck. In other words the system does not fire on the passage of a three-axle truck. If it is a four-axle locomotive, the system will wait to determine the timing of additional axles and start firing only after passage of the first two-axle truck of the first car. Logic is based on the time lapse between consecutive wheel sensing and distances between axles of most available trucks of cars and locomotives. If there is a truck of unusual dimensions it will fool the software temporarily, causing the software to pause momentarily, reset itself, and start with the logic again. By this method the system will succeed in assessment of the passage of wheels the majority of the time.

The quantity of lubricant applied to the rail is intended to be very small, consisting of only a few milliliters per shot. The purpose of this is to develop a very thin film on the rail/wheel contacting surfaces of non-tractive car wheels and skip the lubrication of tractive locomotives wheels. This permits the reduction of lateral forces on the rail and wheel flange. Reduction of flange friction for all car wheels is also achieved. Since very small controlled quantities of the fluid are applied to the rail, a considerably cleaner track is achieved in comparison to the present grease bar lubrication method. Improved life of track, reduced cost of lubricant and track maintenance, increased wheel life and reduced possibility of car derailment are all achieved without compromising locomotive traction ability.

The nozzle bodies 16, 17 are connected hydraulically to the control box 26 which is powered by AC power 32 or DC battery voltage 33 charged with solar cells 34. As the train cars pass by the nozzle body 16, 17 the lead axle 43 of truck 54 triggers the shot but truck 55 and 56 wheels do not. In this way, there will be a shot corresponding to each car. If the amount of fluid applied to the rail is to be reduced there are two approaches by which this can be accomplished:

1) Decrease the amount delivered in one shot by the finite displacement pump.

2) If further reduction is desired, the frequency of taking a shot can be reduced from every car to every other car or every third car, etc.

There can be different variations of the control logic. Another scenario is firing the shot based on the speed of the train. The intervals of time between two different shots will be reduced as the speed of the train is higher. Under this approach, the lubricant shots will be fired at a frequency based on the speed of the train. The lubricant shots will deliver lubricant to the rail head surface, although occasionally one of the shots might get intercepted by a wheel.

Figure 9:
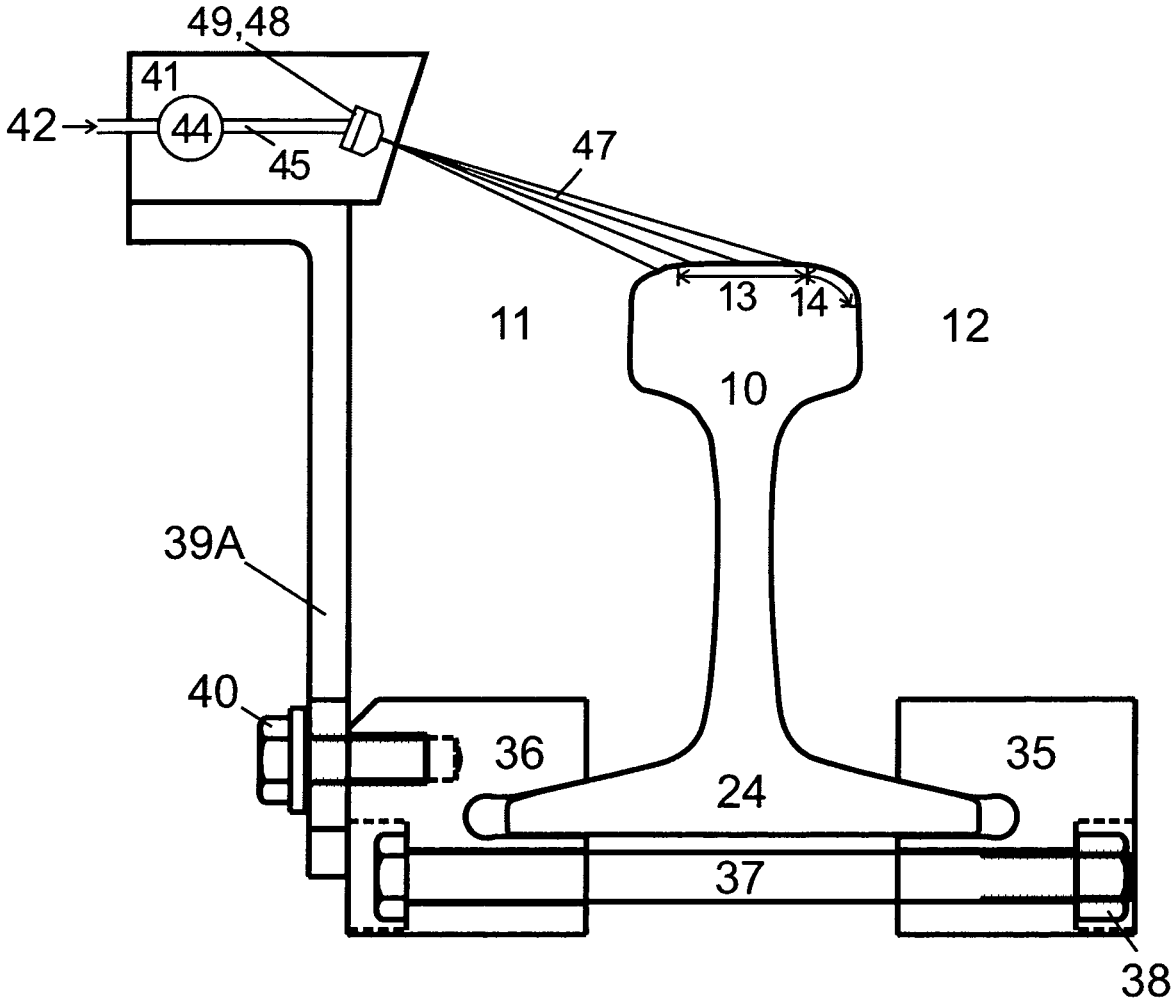
FIG. 9 is a cross-section of a rail showing an alternate embodiment wherein the nozzle block is placed on the field side of the rail above the rail.

An alternate embodiment of the lubricator is shown in FIG. 9. This variation has a nozzle body 41 mounted on the field side 11 of rail 10. An elongated L-section 39A supports the nozzle body 41 above the rail. The bracket 36 will be sized to locate the L-section 39A laterally of the rail a distance sufficient to prevent the nozzle body from being struck by passing wheels, axles or other car equipment. The nozzle discharge orifices are aimed downwardly, laterally, and longitudinally toward the center line of the rail. The angle between lateral and longitudinal directions is selected to maximize spreading of lubricant on the rail head. This nozzle location can be used when something prevents mounting the nozzle on the gage side of the rail. There is however an increased risk of the nozzle block being hit in train operation. The bracket 39A will need to be removed before rail grinding.

It is important to note that the described lubricator lubricates both the top of the rail and the gage corner at the same time. So far as the inventor is aware, this has not been done before.

It will be understood that the embodiments of the present invention which have been described are illustrative of some of the applications of the principles of the present invention. Numerous modifications may be made by those skilled in the art without departing from the true spirit and scope of the invention, including those combinations of features that are individually disclosed or claimed herein. For example, while the lubricator has been described as being used in curved sections of track, it could also be applied to tangent track for the purpose of reducing lateral forces on the rails. Also, while it is most convenient, and therefore preferred, to clamp the nozzle support brackets 35, 36 to the rail base, the bracket supporting the nozzle body could alternately be redesigned so as to be attachable to a tie or even supported by the ballast. Further, alternate forms of the pressurizing means are contemplated. A motor-driven pump could be used with solenoid valves controlled by a pulse width modulation method. An air compressor could be used with a diaphragm tank to apply pressure above the surface of the lubricant in the reservoir. Replaceable compressed air tanks could be used to pressurize the lubricant in the reservoir. Either of these arrangements would require some sort of valve in the supply line to the nozzle body. The sensor is described as a wheel sensor but alternately it could sense other parts of the car.

What is claimed is:

1. A rail lubricating apparatus for use on a railroad track having rails supported by ties resting on ballast, each rail having a field side, a gage side, a top surface and a gage corner, the rails adapted for passage of wheels thereover, wherein the wheels have a flange that runs along the gage corner of the rail and the flange extends to a level below the top surface of the rail, the rail lubricating apparatus comprising:

at least one nozzle defining a passage therein which terminates at a discharge orifice, the nozzle being adapted to be supported by one of the rails, ties or ballast in a position wherein the nozzle is adjacent to the gage side of the rail and located below the top surface of said rail and below the flange level of the passing wheels, the orifice aimed to discharge a jet of lubricant upwardly, substantially longitudinally of the rail, and laterally toward at least one of the top surface and gage corner of the rail;

a railroad car sensor mounted in operative proximity to a rail;

a lubricant reservoir including pressurizing means for supplying lubricant under pressure to the nozzle passage;

a supply line providing fluid communication between the lubricant reservoir and the nozzle passage;

a controller connected to at least one of the lubricant reservoir and the supply line, the controller being responsive to the sensor to start and stop lubricant flow to the nozzle, the controller causing a jet of lubricant to be discharged from the discharge orifice, the jet of lubricant wetting the gage corner and top surface of the rail.

2. The rail lubricating apparatus of claim 1 further comprising a bracket adapted to be attached to one of the rails, ties or ballast, the nozzle being mounted on the bracket.

3. The rail lubricating apparatus of claim 2 wherein the bracket is mountable to the rail base.

4. The rail lubricating apparatus of claim 1 further comprising a check valve disposed in the nozzle passage.

5. The rail lubricating apparatus of claim 1 wherein the pressurizing means comprises a finite displacement pump.

6. The rail lubricating apparatus of claim 1 further comprising a second railroad car sensor mounted in operative proximity to a rail and longitudinally spaced from the nozzle in a direction opposite that of the other sensor.

7. The rail lubricating apparatus of claim 1 wherein the nozzle passage further comprises a second discharge orifice aimed longitudinally of the rail and in the opposite direction from the other discharge orifice.

8. The rail lubricating apparatus of claim 1 wherein the angle of the jet in the vertical plane parallel to the rail is between 1° and 90° from the horizontal.

9. The rail lubricating apparatus of claim 1 wherein the angle of the jet compared to the longitudinal axis of the rail is about 2°.

10. The rail lubricating apparatus of claim 1 wherein the horizontal distance of the nozzle discharge orifice from the rail is between 1/16 inches to 2 inches.

11. The rail lubricating apparatus of claim 1 wherein the nozzle is between 3/4 to 3 inches below the top of the rail.

12. A method for lubricating a gage corner and top surface of a rail in a railroad track, the rail having a gage side and a field side and being adapted for passage of wheels thereover, wherein the wheels have a flange that runs along the gage corner of the rail and the flange extends to a level below the top surface of the rail, the method comprising the steps of:

mounting at least one nozzle adjacent to a gage side of a rail with the discharge orifice of the nozzle beneath the top surface of said rail and the nozzle below the flange level of a passing wheel;

aiming the discharge orifice upwardly, substantially longitudinally of the rail and laterally toward at least one of the top surface and gage corner of the rail;

emitting a jet of lubricant from the nozzle's discharge orifice, at least a portion of said jet beginning beneath the rail top surface and then falling back onto the gage corner and top surface of the rail.

13. The method of claim 12 further comprising the steps of sensing the passage of a railroad car and controlling the nozzle to emit lubricant when the car's trucks span the nozzle.

14. The method of claim 13 further comprising the steps of distinguishing locomotives from railroad cars and emitting the lubricant only after the locomotives pass the nozzle.

15. The method of claim 12 wherein the mounting step is further characterized by mounting the nozzle such that the angle of the jet in the vertical plane parallel to the rail is between 1° and 90° from the horizontal.

16. The method of claim 12 wherein the mounting step is further characterized by mounting the nozzle such that the angle of the jet compared to the longitudinal axis of the rail is between about 2°.

17. The method of claim 12 wherein the mounting step is further characterized by mounting the nozzle such that the horizontal distance of the nozzle discharge orifice from the rail is between 1/16 inches to 2 inches.

18. The method of claim 12 wherein the mounting step is further characterized by mounting the nozzle such that the nozzle is between ¾ to 3 inches below the top of the rail.

19. The method of claim 12 wherein the aiming step is further characterized by aiming the nozzle such that the jet grazes the rail to disperse the jet into a fluid curtain.

20. The method of claim 12 further comprising the step of mounting at least one train sensor to the track at a distance from the nozzle which is proportional to an average train speed for the track.

21. A rail lubricator for applying a lubricant to the gage corner and top surface of a rail of a railroad track, the rail having a gage side and a field side and being adapted for passage of wheels thereover, wherein the wheels have a flange that runs along the gage corner of the rail and the flange extends to a level below the top surface of the rail, the lubricator comprising at least one nozzle having a discharge orifice, the nozzle being attachable to the rail such that the nozzle is adjacent to the gage side of the rail with the discharge orifice located beneath the flange level of a passing wheel, the discharge orifice being aimed substantially longitudinally of the rail but having both an upward component directed toward the top surface of the rail and a lateral component directed toward the centerline of the rail, and the nozzle configured to emit a jet of lubricant that wets a portion of the gage corner and the top surface of the rail.

22. The rail lubricator of claim 21 wherein the nozzle is operably connected to a controller, the controller effective to emit lubricant from the nozzle onto the rail after passage of a locomotive.

23. The rail lubricator of claim 21 further comprising a bracket adapted to be attached to the rail, the nozzle being mounted on the bracket.

24. The rail lubricator of claim 23 wherein the bracket is mountable to the rail base.

25. The rail lubricator of claim 21 further comprising a check valve disposed in the nozzle passage.

26. The rail lubricator of claim 21 wherein the nozzle further comprises a second discharge orifice aimed in the opposite direction from the other discharge orifice, the second discharge orifice being aimed generally longitudinally of the rail but having both an upward component directed toward the top surface of the rail and a lateral component directed toward the centerline of the rail.

* * * * *